US010729245B2

(12) United States Patent
Wang

(10) Patent No.: US 10,729,245 B2
(45) Date of Patent: Aug. 4, 2020

(54) STORAGE SHELF AND TRANSVERSE BEAM THEREOF

(71) Applicants: HANGZHOU GREAT STAR INDUSTRIAL CO., LTD., Hangzhou, Zhejiang Province (CN); HANGZHOU UNITED ELECTRIC MANUFACTURE CO., LTD., Hangzhou, Zhejiang Province (CN)

(72) Inventor: Weiyi Wang, Hangzhou (CN)

(73) Assignees: Hangzhou Great Star Industrial Co., Ltd., Hangzhou, Zhejiang Province (CN); Hangzhou United Electric Manufacture Co., Ltd., Hangzhou, Zhejiang Province (CN)

( * ) Notice: Subject to any disclaimer, the term of this patent is extended or adjusted under 35 U.S.C. 154(b) by 76 days.

(21) Appl. No.: 15/527,847

(22) PCT Filed: Apr. 15, 2015

(86) PCT No.: PCT/CN2015/076657
§ 371 (c)(1),
(2) Date: May 18, 2017

(87) PCT Pub. No.: WO2016/078305
PCT Pub. Date: May 26, 2016

(65) Prior Publication Data

US 2018/0344031 A1 Dec. 6, 2018

(30) Foreign Application Priority Data

Nov. 19, 2014 (CN) ..... 2014 2 0691679 U

(51) Int. Cl.
*A47B 57/00* (2006.01)
*A47B 96/06* (2006.01)
(Continued)

(52) U.S. Cl.
CPC ..... *A47B 96/1441* (2013.01); *A47B 47/00* (2013.01); *A47B 47/0083* (2013.01); *A47B 57/06* (2013.01); *B25H 3/04* (2013.01)

(58) Field of Classification Search
CPC ..... A47B 96/1441; A47B 96/06; A47B 57/50
See application file for complete search history.

(56) References Cited

U.S. PATENT DOCUMENTS 2,058,263 A 10/1936 Rosendale
2,169,182 A 8/1939 Kost
(Continued)

FOREIGN PATENT DOCUMENTS

CN 201468493 U 5/2010
CN 101265931 B 7/2010
(Continued)

OTHER PUBLICATIONS

International Search Report dated Aug. 24, 2015 from corresponding International Application No. PCT/CN2015/076657, 8 pages.
(Continued)

*Primary Examiner* — Kimberley S Wright
(74) *Attorney, Agent, or Firm* — Ohlandt, Greeley, Ruggiero & Perle, L.L.P.

(57) ABSTRACT

The invention discloses a storage shelf, comprising upright posts (1) and transverse beams (2), and further comprising shelf boards (3), wherein first reinforcement ribs (4) are provided on the transverse beams; and the first reinforcement ribs can both reinforce the transverse beams and serve as supporting parts for the shelf boards, having a simple structure without reducing the strength of the transverse beams. The transverse beams and the upright posts are directly connected by way of clamping, and can be assembled and disassembled conveniently.

11 Claims, 4 Drawing Sheets

(51) Int. Cl.

| | |
|---|---|
| ***A47B 96/14*** | (2006.01) |
| ***B25H 3/04*** | (2006.01) |
| ***A47B 57/06*** | (2006.01) |
| ***A47B 47/00*** | (2006.01) |

(56) References Cited

U.S. PATENT DOCUMENTS

| | | | | | |
|---|---|---|---|---|---|
| 2,264,243 | A | | 11/1941 | Knuth | |
| 3,029,056 | A | * | 4/1962 | Breglia | A47B 96/061 248/243 |
| 3,124,402 | A | * | 3/1964 | Rhoads | A47B 88/483 211/162 |
| 3,362,278 | A | | 1/1968 | Munse | |
| 3,523,612 | A | * | 8/1970 | Hall | A47B 57/30 108/106 |
| 3,693,556 | A | | 9/1972 | Rous | |
| 3,862,691 | A | * | 1/1975 | Mori | A47B 57/40 108/156 |
| 4,285,436 | A | | 8/1981 | Konstant et al. | |
| 5,921,643 | A | | 7/1999 | Louth | |
| 6,123,400 | A | | 9/2000 | Nicolai et al. | |
| 6,908,274 | B1 | | 6/2005 | Vassiliou | |
| 7,191,908 | B2 | * | 3/2007 | De Rijk | A47B 57/32 211/187 |
| 7,252,202 | B2 | | 8/2007 | Saltzberg et al. | |
| 9,101,216 | B2 | * | 8/2015 | Fitzgerald | A47B 57/50 |
| 9,301,610 | B1 | * | 4/2016 | Berry | A47B 96/1416 |
| 9,474,369 | B1 | * | 10/2016 | Tsai | A47B 47/0083 |
| 9,661,921 | B1 | * | 5/2017 | Tsai | A47B 57/50 |
| 2005/0103733 | A1 | * | 5/2005 | Saltzberg | A47B 57/50 211/187 |
| 2005/0103734 | A1 | * | 5/2005 | Saltzberg | A47B 57/50 211/187 |
| 2010/0084354 | A1 | * | 4/2010 | Eustace | A47B 57/50 211/134 |
| 2011/0272373 | A1 | * | 11/2011 | Wojtowicz | A47B 87/0215 211/134 |
| 2011/0272541 | A1 | * | 11/2011 | Wojtowicz | A47B 87/0215 248/218.4 |
| 2011/0272542 | A1 | * | 11/2011 | Wojtowicz | A47B 87/0215 248/218.4 |
| 2012/0000872 | A1 | * | 1/2012 | Troyner | A47B 47/021 211/150 |
| 2012/0000873 | A1 | * | 1/2012 | Fitzgerald | A47B 57/50 211/153 |
| 2014/0217252 | A1 | * | 8/2014 | Fitzgerald | A47B 57/50 248/218.4 |
| 2015/0282613 | A1 | * | 10/2015 | Chen | A47B 55/00 211/187 |

FOREIGN PATENT DOCUMENTS

| | | | |
|---|---|---|---|
| CN | 102949019 | A | 3/2013 |
| CN | 203880344 | U | 10/2014 |
| DE | 148180 | A1 | 5/1981 |
| GB | 449681 | | 7/1936 |
| GB | 1080997 | A | 8/1967 |

OTHER PUBLICATIONS

Written Opinion dated Aug. 24, 2015 from corresponding International Application No. PCT/CN2015/076657, 4 pages.

* cited by examiner

STORAGE SHELF AND TRANSVERSE BEAM THEREOF

FIELD OF THE INVENTION

The present invention relates to the structure of a storage shelf and transverse beam thereof.

DESCRIPTION OF THE PRIOR ART

In the processing workshop of a factory, storage shelves are tools for storing components and parts; therefore, plurality of storage shelves would be placed in the workshop.

Most of the storage shelves have multilayer structure, and shelf boards are placed in every layer and positioned on transverse beams; therefore, every storage shelf has plurality of transverse beams, thus all the storage shelves in a workshop require a large quantity of transverse beams.

With the large quantity of transverse beams, the cost of the storage shelves increases. To reduce the cost, the structure of the transverse beams is simplified, the changes to the structure are liable to cause strength reduction, which leads to reduction of weight that can be supported by the transverse beams, thus the quantity of components and parts that can be placed on the storage shelves decreases.

Plurality of upright posts of present storage shelves connect to the transverse beams by bolts, such way of connection makes it comparatively troublesome to be assembled and disassembled, which costs a longer time, if there is a need to increase the quantity of the shelf boards on the storage shelves, the efficiency is comparatively low.

Therefore, persons skilled in the art devote themselves to developing a structure of storage shelves which is convenient to be assembled and disassembled, low costing without strength reduction.

SUMMARY OF THE INVENTION

The present invention provides a storage shelf, wherein first reinforcement ribs are provided on transverse beams, which can both reinforce the transverse beams and serve as supporting parts for the shelf boards, having a simple structure without reducing the strength of the transverse beams.

The present invention solves the problems that present storage shelves adopt bolted connections, which are comparatively time-consuming to assemble and disassemble and troublesome to change the quantity of shelf boards. The present invention provides a storage shelf, wherein transverse beams and upright posts are directly connected by way of clamping, and can be assembled and disassembled conveniently.

The specific technical solution that solves the technical problem is: a storage shelf, comprising upright posts and transverse beams, extended first reinforcement ribs are provided on the transverse beams along the length direction thereof. The first reinforcement ribs have supporting parts, and the supporting parts are configured for supporting shelf boards. The transverse beams connect with the upright posts by connecting parts.

Preferably, the first reinforcement rib is provided in the middle of the transverse beam along the width direction thereof, making it uniformly forced.

Preferably, the first reinforcement ribs are punched from the body of the transverse beams, of which the manufacturing method is simple and quick.

As a preferable way, the first reinforcement rib consists of an inclined part and a transverse part, upper surface of the transverse part is a supporting surface, and the shelf board is placed on the supporting surface.

The specific structure in the preferably way can be: the transverse part is tabular shaped, and the supporting surface is a supporting plane, the manufacture of such structure is the easiest; or the transverse part is arc shaped, and the supporting surface is curved supporting surface, which can increase the supporting strength; the support surface can further be wavy supporting surface, generating multiple contact lines, thereby increasing the fiction force between the supporting surface and the shelf boards.

The transverse part supports the shelf board, and the inclined part serves as support to the transverse part, which is tabular shaped, having simple structure for manufacturing; or the inclined part is arc shaped, having higher supporting strength; round bend is adopted between the inclined part and the transverse part to make it resistant to break.

As another preferable way, the first reinforcement rib consists of two inclined parts with different slopes which slope upward, and the bend angle between the two inclined parts serves as the supporting angle of the shelf board; the advantage of such structure lies in that: when bearing higher pressure of goods, such structure is more resistant to slope down due to deformation compared to the structure of the transverse part and the inclined part.

Preferably, the angle between the upper inclined part of the two inclined parts and the transverse beam main plane is between 60-85°.

Similarly, the two inclined parts can be tabular shaped or arc shaped, round bend is adopted between the two inclined parts.

Preferably, the distance between the supporting surface or supporting angle of the first reinforcement rib and the upper edge of the transverse beam matches the thickness of the shelf board.

Four transverse beams are connected to the upright post in a layer, therefore, there may be interference between the ends of the transverse beams; to avoid the interference, both ends of the first reinforcement rib are inclined ends.

Preferably, the first reinforcement rib is provided in the middle of the transverse beam along the width direction thereof, a second reinforcement rib is provided on the upper side of the transverse beam, which is on the same side of the first reinforcement rib downwardly folding 180°; further preferably, the folding surface is a smooth surface, and the folding angle is rounded corner. The lower side of the transverse beam can be straight.

However, as a preferable way, a third reinforcement rib can be provided on the lower side of the transverse beam, which is on the same side of the first reinforcement rib folding 90°; or on the basis of the third reinforcement rib folding 90°, a fourth reinforcement rib upwardly folding 90° is further provided adjacent to the edge; similarly preferably, all the folding surfaces are smooth surfaces, and the folding angles are rounded corners.

As another preferable way, in addition to the first reinforcement rib mentioned above, an arcuate projection serving as a fifth reinforcement rib can be provided on the transverse beam extending along the length direction thereof (on the same side of the first reinforcement rib); the arch curved surface not only has aesthetic appearance, more importantly, the smooth surface makes hands not easily hurt during assembling and disassembling.

Preferably, connecting parts are provided on both ends of the transverse beam for connecting with the upright posts, and the connecting parts are provided more than one at each end, which are arranged on both sides of the first reinforcement rib along the width direction of the transverse beam respectively, making it uniformly forced and more secured.

Preferably, connecting parts adopt rivet structure; rivet head and the first reinforcement rib are placed on both sides of the transverse beam main plane respectively; a gap is reserved between the rivet head plane and the transverse beam surface, and the gap is of the thickness of the upright post sheet. The rivet serves as the connecting part, making it easier for connection, in addition, connecting part with hook structure can also be adopted.

Preferably, the upright post includes two right-angled planes, whereon clamp holes are provided, the clamp hole is a combination of a big hole and a small hole interconnected with each other, and the transverse beam clamps with the clamp hole by a connecting part. The rivet is directly clamped into the clamp hole, which is convenient for assembling and disassembling.

Preferably, multiple mutual corresponding clamp holes are provided on the two planes of the upright post along its extending direction.

As a further preferable way, the distance between each adjacent clamp holes on each plane is equal, and corresponding to the distance between the connecting parts on both sides of the first reinforcement rib on the transverse beams. In this way, the match between the upright post and the transverse beams can be ensured, and it is a design for installing relatively larger amount of transverse beams, therefore, the space can be taken full advantage of if there is a need.

Preferably, the interconnected big holes and small holes are all circular holes; rivets serving as connecting parts are provided on the transverse beams, and the diameter of the big hole is larger than that of the rivet head; the diameter of the small hole is between the diameters of the rivet head and the rivet rod. Further preferably, the diameter of the small hole equals to the diameter of the rivet rod, in this way, the transverse beams can be better fixed without horizontal movement.

The present invention has the beneficial effects that the transverse beams connect with the upright posts by connecting parts, the first reinforcement ribs on the transverse beams can both increase the strength of the transverse beams and support the shelf boards, having simple structure without reducing the strength of the transverse beams.

In conjunction with the following drawings, the concept of the present invention, the specific structure and the resulting technical effect will be further described to fully understand the objects, features and effects of the present invention.

Reference signs: 1. upright post, 2. transverse beam, 3. shelf board, 4. first reinforcement rib, 5. inclined end, 6. rivet, 7. reinforcement rib, 8. transverse part, 9. inclined part, 10. clamp hole.

DETAILED DESCRIPTION OF THE PREFERRED EMBODIMENTS

Combining the figures, the following further explains the technical solution of the present invention in details by specific embodiments.

Figure 1:
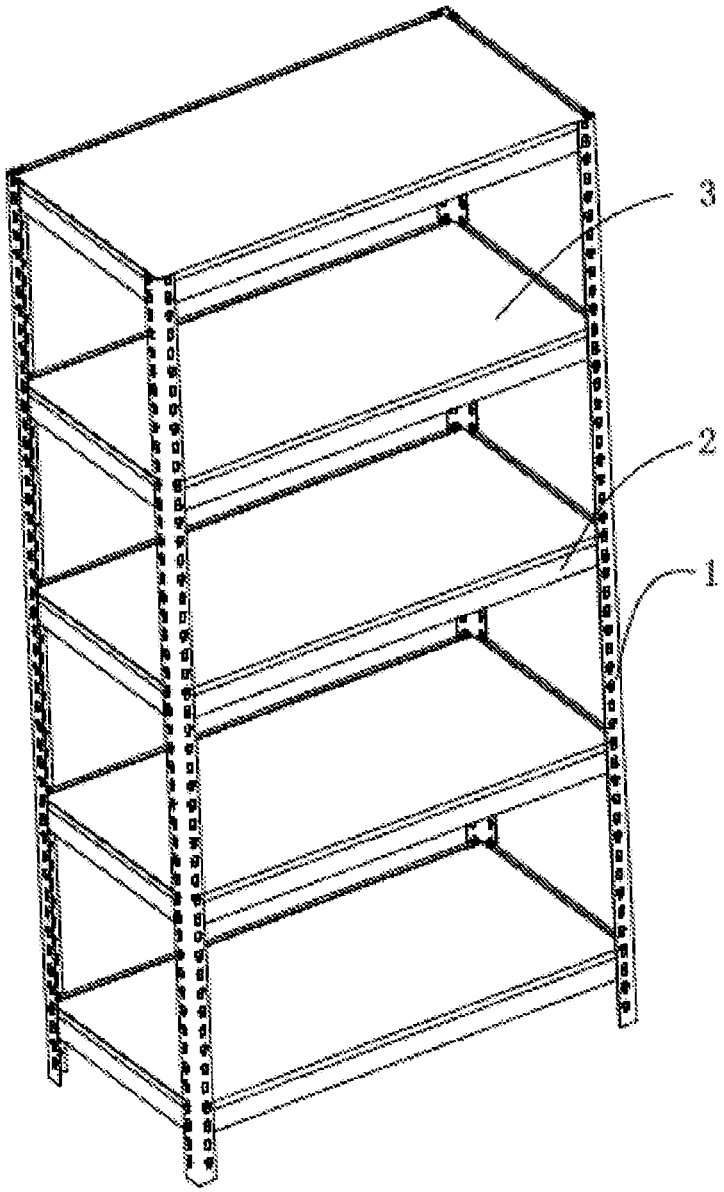
FIG. 1 is a schematic structural view of the present invention.
Figure 2:
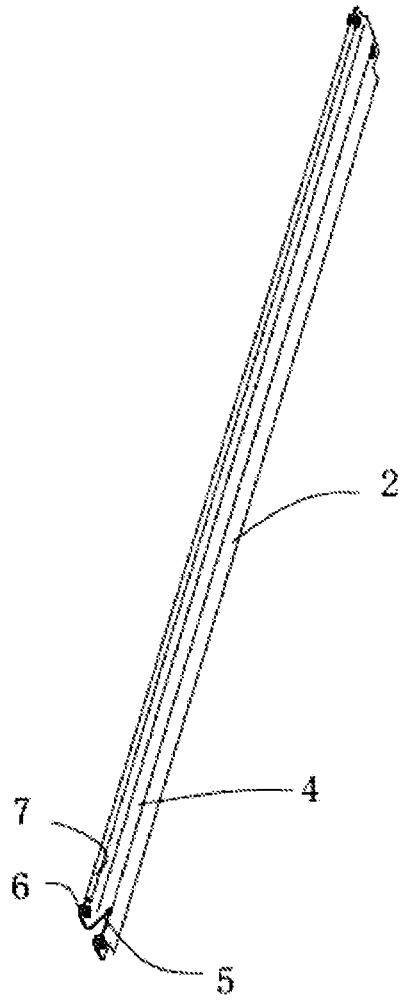
FIG. 2 is a schematic perspective view of a transverse beam of the present invention.
Figure 3:
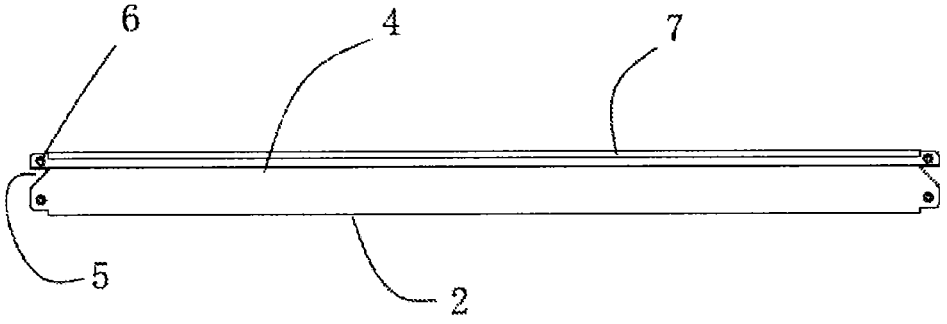
FIG. 3 is a front view of a transverse beam of the present invention.

A storage shelf (see FIG. 1) comprises upright posts 1, transverse beams 2 and shelf boards 3. There are four upright posts, whereon connected are two ends of the transverse beams; four transverse beams form a layer, and a shelf board is placed on the transverse beams for each layer. A storage shelf may have multilayers according to the need; and the distance between the layers is variable.

Two rivets 6 are fixed on both ends of the transverse beams respectively (see FIGS. 2, 3, 4, 7), serving as the connecting parts to the upright posts, the two rivets on the same end are arranged in up-down structure; a gap is reserved between the rivet head plane and transverse beam surface, and the gap is of the thickness of the upright post sheet. In addition to rivet, the connecting parts can be other ways that are available for clamping, for example, hook, etc.

A first reinforcement rib 4 is provided along the length direction between the upper rivet and lower rivet on the transverse beam, and the first reinforcement rib is best located in the middle of the transverse beam, making it uniformly forced. Two ends of the first reinforcement rib are inclined ends 5; the inclined angle of the inclined end is not larger than 45°, in this way, the interference between the ends of the transverse beams when connecting with the upright posts can be avoided.

The first reinforcement rib consists of an inclined part 9 and a transverse part 8, the upper surface of the transverse part is a supporting surface, and a shelf board is placed on the supporting surface. The transverse part is tabular shaped, and the supporting surface is a supporting plane; the inclined part is tabular shaped, and round bend is adopted between the transverse part and the inclined part. The distance between the supporting surface of the first reinforcement rib and the upper edge of the transverse beam matches the thickness of the shelf board, and the rivet head and the first reinforcement rib are placed on both sides of the transverse beam main plane respectively.

Figure 5:
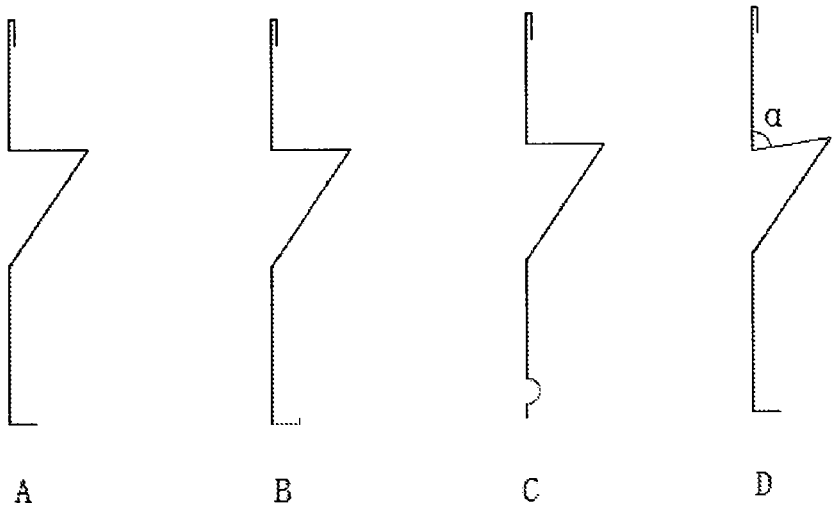
FIG. 5 is a side view structural diagram of four optional transverse beams of the present invention.

In another preferred embodiment, the first reinforcement rib consists of upper and lower inclined parts (see D in FIG. 5), the slope of the lower inclined part is larger than that of the upper inclined part; the first reinforcement rib slopes upward, and the bend angle between the two inclined parts serves as the supporting angle of the shelf board, such structure is more resistant to slope down due to deformation. Wherein, the angle $\alpha$ between the upper inclined part of the two inclined parts and the transverse beam main plane is between 60-85°.

The transverse part or inclined part mentioned above can be either tabular shaped or arc shaped, and the design of rounded corner is preferably adopted at the folding corners.

Figure 4:
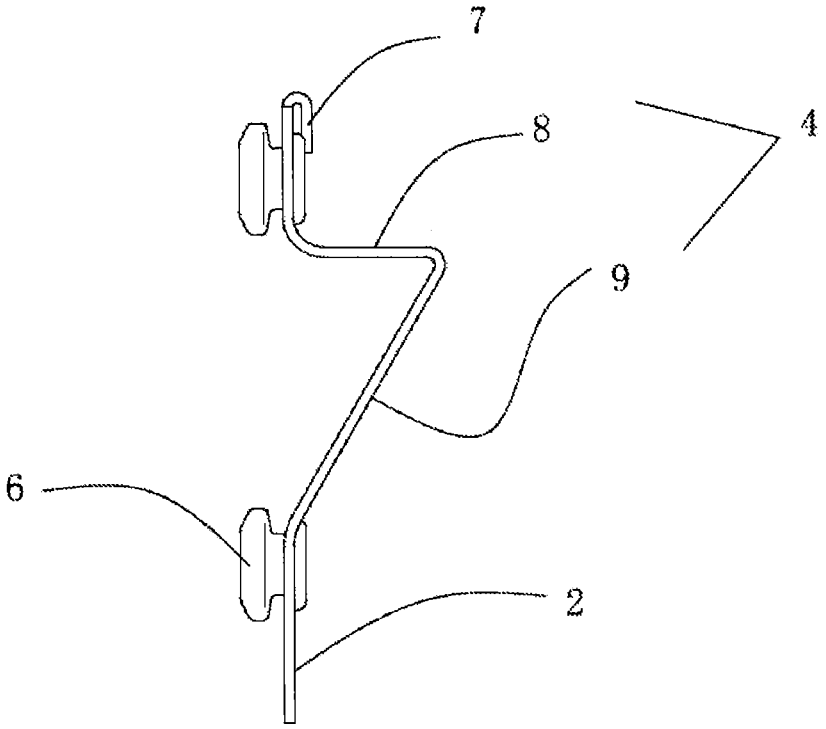
FIG. 4 is a side view of a transverse beam of the present invention.

It can be seen in FIG. 4 that in this embodiment, a second reinforcement rib 7 is provided on the upper side of the transverse beam downwardly folding 180°, and the lower side of the transverse beam is straight. However, other three preferred embodiments are given by A, B, C in FIG. 5. In A, the lower side of the transverse beam has a third reinforcement rib folding 90°; in B, in addition to folding 90°, the lower side of the transverse beam further has a fourth reinforcement rib upwardly folding 90° adjacent to the edge; in C, the lower side of the transverse beam has an arcuate projection serving as a fifth reinforcement rib.

Figure 6:
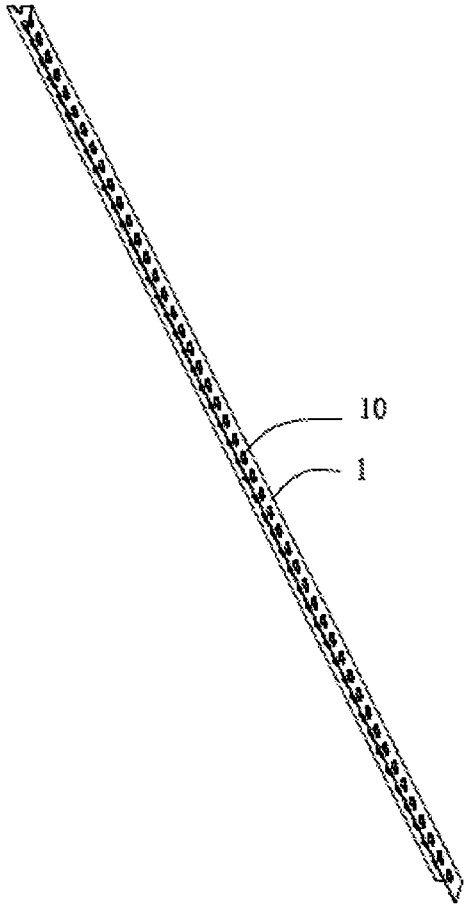
FIG. 6 is a schematic perspective view of an upright post of the present invention.
Figure 7:
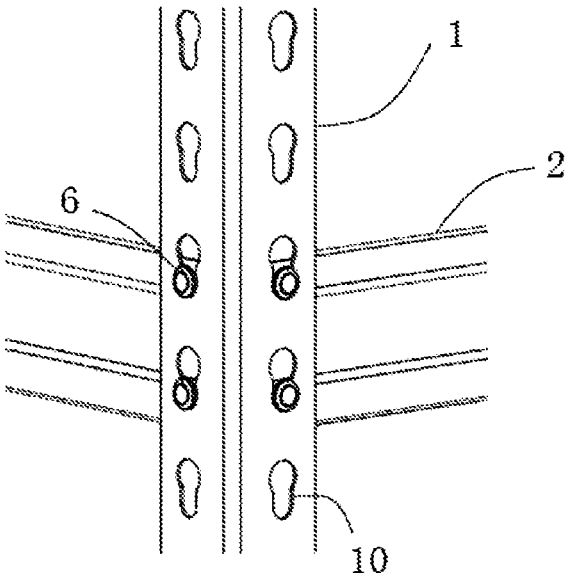
FIG. 7 is a schematic structural view of the junction between an upright post and transverse beam of the present invention.

The upright post includes two right-angled planes, whereon multiple clamp holes 10 are provided (see FIGS. 6 and 7), the clamp hole is a combination of a big circular hole and a small circular hole interconnected with each other. The distances between the clamp holes on the same upright post are uniformly distributed, the distance between the centers of two adjacent small circular holes is the distance between the centers of the two rivet heads on the same end of the transverse beam; the diameter of the big circular hole is larger than that of the rivet head; the diameter of the small circular hole is between the diameters of the rivet head and the rivet rod, or preferably, the diameter of the small circular hole equals to the diameter of the rivet rod.

The transverse beams connect with the upright posts by rivets clamping into the clamp holes, after connection, the first reinforcement ribs relatively face toward the inner position, adjusting the length of the transverse beam can change the length and width of the storage shelf, and apply to shelf boards with different length and width. The transverse beams in the same layer connect into the clamp holes with the same height on the upright posts, and by adjusting the height of the four transverse beams in the same layer on the upright posts, the distance between the layers can be changed.

The foregoing described the preferred embodiments of the present invention. It should be understood that an ordinary one skilled in the art can make many modifications and changes according to the concept of the present invention without creative work. Therefore, any technical solutions that can be obtained by a person skilled in the art depending on the concept of the present invention on the basis of the prior art through logical analysis, reasoning or limited experiments, should all fall in the protection scope defined by the claims.

The invention claimed is:

1. A storage shelf comprising upright posts and transverse beams, wherein an extended first reinforcement rib is provided on each of the transverse beams along the length direction thereof, the first reinforcement rib has a supporting part, and the supporting parts is configured for supporting a shelf board; the first reinforcement rib consists of two inclined parts with different slopes and slopes upward;

wherein the angle between the upper inclined part of the two inclined parts and the transverse beam main plane is between 60-85°, and a bend angle between the two inclined parts serves as a supporting angle of one of the shelf boards;

wherein the first reinforcement rib is provided in the middle of each of the transverse beams along the width direction thereof, a second reinforcement rib is provided on upper side of each of the transverse beams, which is on the same side of the first reinforcement rib downwardly folding 180°; lower side of each of the transverse beams has a third reinforcement rib on the same side of the first reinforcement rib folding 90°, and on the basis of the third reinforcement rib folding 90°, a fourth reinforcement rib upwardly folding 90° is further provided adjacent to the edge.

2. The storage shelf according to claim 1, wherein two ends of the first reinforcement rib are inclined ends.

3. The storage shelf according to claim 1, wherein an arcuate projection serving as a fifth reinforcement rib is provided on each of the transverse beams extending along the length direction thereof which is on the same side of the first reinforcement rib.

4. The storage shelf according to claim 1, wherein connecting parts are provided on two ends of each of the transverse beams for connecting with the upright posts, and the connecting parts are provided more than one at each end, which are arranged on both sides of the first reinforcement rib along the width direction of each of the transverse beams respectively.

5. The storage shelf according to claim 4, wherein the connecting parts adopt rivet structure; rivet head and the first reinforcement rib are placed on both sides of the transverse beam main plane respectively; a gap is reserved between the rivet head plane and the transverse beam plane, and the gap is of the thickness of the upright post sheet.

6. The storage shelf according to claim 1, wherein each of the upright posts comprises two right-angled planes, multiple mutual corresponding clamp holes are provided on the two planes, each of the clamp holes is a combination of a big hole and a small hole interconnected with each other, and the transverse beams clamp with the clamp holes by a connecting part.

7. A transverse beam of storage shelf, wherein an extended first reinforcement rib is provided on the transverse beam along the length direction thereof, the first reinforcement rib has a supporting part, and the supporting part is configured for supporting a shelf board; the first reinforcement rib consists of two inclined parts with different slopes and slopes upward;

wherein the angle between the upper inclined part of the two inclined parts and the transverse beam main plane is between 60-85°, and a bend angle between the two inclined parts serves as a supporting angle of one of the shelf boards;

wherein the first reinforcement rib is provided in the middle of each of the transverse beams along the width direction thereof, a second reinforcement rib is provided on upper side of each of the transverse beams, which is on the same side of the first reinforcement rib downwardly folding 180°; lower side of each of the transverse beams has a third reinforcement rib on the same side of the first reinforcement rib folding 90°, and on the basis of the third reinforcement rib folding 90°, a fourth reinforcement rib upwardly folding 90° is further provided adjacent to the edge.

8. The transverse beam of storage shelf according to claim 7, wherein two ends of the first reinforcement rib are inclined ends.

9. The transverse beam of storage shelf according to claim 7, wherein an arcuate projection serving as a fifth reinforcement rib is provided on the transverse beam extending along the length direction thereof.

10. The transverse beam of storage shelf according to claim 7, wherein connecting parts are provided on two ends of the transverse beam for connecting the upright post, and the connecting parts are provided more than one at each end, which are arranged on both sides of the first reinforcement rib along the width direction of the transverse beam respectively.

11. The transverse beam of storage shelf according to claim 10, wherein the connecting parts adopt rivet structure; rivet head and the first reinforcement rib are placed on both sides of the transverse beam main plane respectively; a gap is reserved between the rivet head plane and the transverse beam plane, and the gap is of the thickness of the upright post sheet.

* * * * *